US011684182B2

(12) United States Patent
Nelson

(10) Patent No.: US 11,684,182 B2
(45) Date of Patent: Jun. 27, 2023

(54) WEEKENDER STYLE FLOOR DISPLAY

(71) Applicant: VANGUARD PACKAGING, LLC, Kansas City, MO (US)

(72) Inventor: Kent Nelson, Lee's Summit, MO (US)

(73) Assignee: Vanguard Packaging, LLC, Kansas City, MO (US)

( * ) Notice: Subject to any disclaimer, the term of this patent is extended or adjusted under 35 U.S.C. 154(b) by 0 days.

(21) Appl. No.: 16/933,487

(22) Filed: Jul. 20, 2020

(65) Prior Publication Data

US 2021/0015273 A1 Jan. 21, 2021

Related U.S. Application Data

(60) Provisional application No. 62/979,191, filed on Feb. 20, 2020, provisional application No. 62/876,478, filed on Jul. 19, 2019.

(51) Int. Cl.
*A47F 5/11* (2006.01)
*A47B 43/02* (2006.01)

(52) U.S. Cl.
CPC ..... *A47F 5/116* (2013.01); *A47B 43/02* (2013.01)

(58) Field of Classification Search
CPC ..... A47B 47/06; A47B 43/02; A47B 43/00; A47B 96/021; A47B 55/06; A47B 45/00; A47B 2220/0083; A47B 2220/0086; A47F 5/11; A47F 5/112; A47F 5/116; A47F 5/114; A47F 5/118
USPC ..... 211/135
See application file for complete search history.

(56) References Cited

U.S. PATENT DOCUMENTS 2,051,093 A * 8/1936 Leigh ..... G09F 5/00 211/72
2,173,917 A * 9/1939 Ryan ..... A47F 5/112 211/73
2,918,178 A * 12/1959 Leone ..... A47F 5/116 211/195
4,311,100 A * 1/1982 Gardner ..... A47F 5/116 108/165
4,570,805 A * 2/1986 Smith ..... A47F 5/116 211/132.1
5,161,699 A * 11/1992 Hanna ..... A47F 5/11 211/130.1
5,213,220 A * 5/1993 McBride ..... A47B 43/00 211/126.16
5,322,172 A * 6/1994 Maglione ..... A47F 5/116 211/126.16
D363,840 S * 11/1995 Weshler ..... D6/683.1
5,758,783 A * 6/1998 Maglione ..... A47B 87/0207 211/126.16
7,252,200 B1 * 8/2007 Hester ..... A47F 5/116 211/126.16
7,677,433 B2 * 3/2010 Little ..... B65D 5/526 229/120.15
8,875,908 B2 * 11/2014 L'Hotel ..... A47B 43/02 211/72

(Continued)

FOREIGN PATENT DOCUMENTS

WO WO-2008127499 A1 * 10/2008 ..... A47F 5/116

*Primary Examiner* — Devin K Barnett
(74) *Attorney, Agent, or Firm* — Kutak Rock LLP

(57) ABSTRACT

A weekender style display and related methods are provided. The display transforms from a knockdown configuration to an erected configuration. The display includes shelf members that are supported at the front, back, and at each side.

6 Claims, 12 Drawing Sheets

(56) References Cited

U.S. PATENT DOCUMENTS 8,944,260 B2 * 2/2015 Hawkins ..... A47B 43/02 211/72
11,154,145 B1 * 10/2021 Pfeifer ..... A47F 5/116
2005/0274684 A1 * 12/2005 Swanson ..... A47B 43/02 211/78
2006/0151407 A1 * 7/2006 Virvo ..... A47F 5/116 211/72
2008/0169339 A1 * 7/2008 Moser ..... B65D 5/5213 229/108.1
2008/0169340 A1 * 7/2008 Sheffer ..... A47F 5/116 229/120.32
2010/0006527 A1 * 1/2010 Kalwat ..... A47F 5/116 211/135
2011/0049072 A1 * 3/2011 Dewhurst ..... A47F 5/116 211/135
2013/0213915 A1 * 8/2013 Pfeifer ..... A47B 43/02 211/135
2013/0277324 A1 * 10/2013 Dewhurst ..... A47F 5/116 211/135
2015/0122694 A1 * 5/2015 Hession ..... A47F 7/283 206/563
2015/0374146 A1 * 12/2015 LeFevre ..... A47F 7/283 211/85.26
2017/0079449 A1 * 3/2017 Smith ..... A47B 43/02
2017/0265655 A1 * 9/2017 Kinzelman ..... A47F 5/116
2018/0070747 A1 * 3/2018 Smith ..... A47B 43/02
2018/0160825 A1 * 6/2018 Abel ..... B65D 5/5213
2018/0293919 A1 * 10/2018 Ertl ..... A47F 5/0025
2019/0008290 A1 * 1/2019 Ertl ..... A47F 5/116
2019/0069694 A1 * 3/2019 Smith ..... A47B 55/06
2020/0024027 A1 * 1/2020 Nelson ..... B65D 5/44
2020/0260866 A1 * 8/2020 Gibbons, Jr. ..... A47F 5/116
2020/0297132 A1 * 9/2020 Nguyen ..... A47F 5/116
2021/0076818 A1 * 3/2021 Felsenthal ..... A47B 96/02
2021/0244178 A1 * 8/2021 Gibbons, Jr. ..... A47F 5/116

* cited by examiner

WEEKENDER STYLE FLOOR DISPLAY

CROSS-REFERENCE TO RELATED APPLICATIONS

This application claims priority pursuant to 35 U.S.C. 119(e) to U.S. Provisional Patent Application Ser. No. 62/876,478, filed Jul. 19, 2019, and to U.S. Provisional Patent Application Ser. No. 62/979,191, filed Feb. 20, 2020, the entire disclosure of which is incorporated herein by reference.

FIELD OF THE INVENTION

The present invention relates generally to point of purchase merchandise displays. More specifically, the present invention is concerned with a corrugated, paperboard display that is manufactured in a fold and/or glue assembly process and that is traditionally provided to an end user in a collapsed or knockdown configuration for setup.

BACKGROUND

Corrugated displays and containers are often made from pieces of flat paperboard stock material that are die cut into shapes that define various panels. The shapes are folded along predefined lines between the panels, often with at least one overlapping strip or panel that is glued, taped or otherwise affixed to another panel to form an enclosed boundary. The panels are folded and/or glued into place to become the walls of the display or container. The displays or containers are traditionally provided to product manufacturers and/or retailers in a collapsed or knockdown configuration for storage, handling and shipping. The manufacturer and/or retailers open the knockdown containers and fold appropriately to utilize the assembled display or container for display and/or packing products therein.

The knockdown displays or containers are typically manufactured by feeding flat die cut sheets through a fold-and-glue machine. The fold-and-glue machine applies adhesive and folds over select panels so that the panels are in the knockdown configuration. One common knockdown display is a weekender style display. A corrugated weekender display is typically used to display products to consumers at a point-of-sale location. In some instances, several weekender displays are utilized at a single location, often requiring significant resources to purchase, erect, locate, and load the same. Such problems are compounded when weekender displays are specialized displays, such as displays that are designed for a specific limited-time promotion, such as for a seasonal promotion, a product promotion (such as on a release date, during a sale, or other times during which demand is higher than normal), a product clearance event (or other circumstance during which temporary display options are desired), and/or the like. Consequently, it is desirable to minimize the time and effort necessary to manufacture the weekender display and/or to erect the display from its knockdown configuration.

Historically, weekender displays provide support on only the front and back of the shelf. As a result, weekender displays have relatively weak shelves that cannot support much weight, thereby limiting the versatility and/or decreasing their useful life. Thus, it would be beneficial to provide a weekender style display that provides added shelf support, such as shelf support on both sides of the shelf in addition to the traditional support on the front and back of the shelf. Also, it would be beneficial to provide a weekender style display that can be assembled entirely from the front of the display to reduce assembly time.

SUMMARY

In one aspect, the invention provides a weekender display having a rear panel with support apertures, two side panels, a front panel, and at least two shelf assemblies. In one embodiment, the weekender display has a bottom including several bottom panels. In one embodiment, the weekender display has a top including a top panel and two side panels. In one embodiment, each shelf assembly includes a portion of the front panel, a shelf member panel, two side support panels, and a tab panel with a tab member. Here, each support aperture receives a tab member to support the shelf against the rear panel. In some embodiments, each side support panel is separated from the shelf member panel by a fold line and is separated from each side panels by a fold line and a cut line. In another embodiment, each tab panel is separated from the front panel by a cut line.

In another embodiment, the weekender display has two opposed shelving scenes that share a rear panel and two side panels. Here, "rear" means behind each shelf but within the central plane bisecting the display and each side panel. In one embodiment, the opposed shelves are back-to-back or coplanar. In another embodiment, the opposed shelves are off-set or alternating.

In one embodiment, the weekender display is in a single-piece knock-down configuration.

In one embodiment, the weekender display is made of corrugated cardboard.

In another aspect, the invention provides a method for erecting a weekender display. In one embodiment, the panels of a knock-down embodiment of the weekender display are folded, secured by tabs, and optionally glued as needed. In one embodiment, rear panels are folded toward the side panels, the side panels are folded toward the front panel to form a box with an interior, bottom panels are then folded toward the interior of the box, each shelf member is folded away from the interior and the tab panels are mated with the support apertures in the rear panel.

In another aspect, the invention provides a method for erecting a weekender display having two opposing display scenes with two front panels. In one embodiment, the panels of a knock-down embodiment of the weekender display are folded, secured by tabs, and optionally glued as needed. In one embodiment, the rear panel is folded toward a first side sub-panel, a second side sub-panel is folded toward a second front panel, the second front panel is folded toward a second side panel (which is continuous, i.e., not comprised of sub-panels), the second side panel is folded toward a first front panel, the bottom panels are folded inwardly, and the shelves are folded and secured as described in the preceding aspect. In one embodiment, an outer edge of said rear panel is adhered to the midline of the second side panel and a free end of the second side sub-panel is adhered to the first side sub-panel to form the first side panel (here, the first side panel is discontinuous).

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION

The present invention comprises a display having a base and a plurality of shelf assemblies, each formed from a single piece of material. The base includes a plurality of panels separated by respective fold lines so as to facilitate moving the display from a knockdown configuration to an erected configuration. Each shelf assembly includes a shelf member flanked by opposed side support panels, the shelf assembly being moved between a stowed configuration and a deployed configuration as the display is moved between the knockdown configuration and the erected configuration, respectively. In some embodiments, the display is moveable to one or more flat configurations, such as by folding and gluing one or more panel together such that the display maintains a relatively low profile to facilitate shipping and storage while being readily moveable to an erected configuration.

Figure 1:
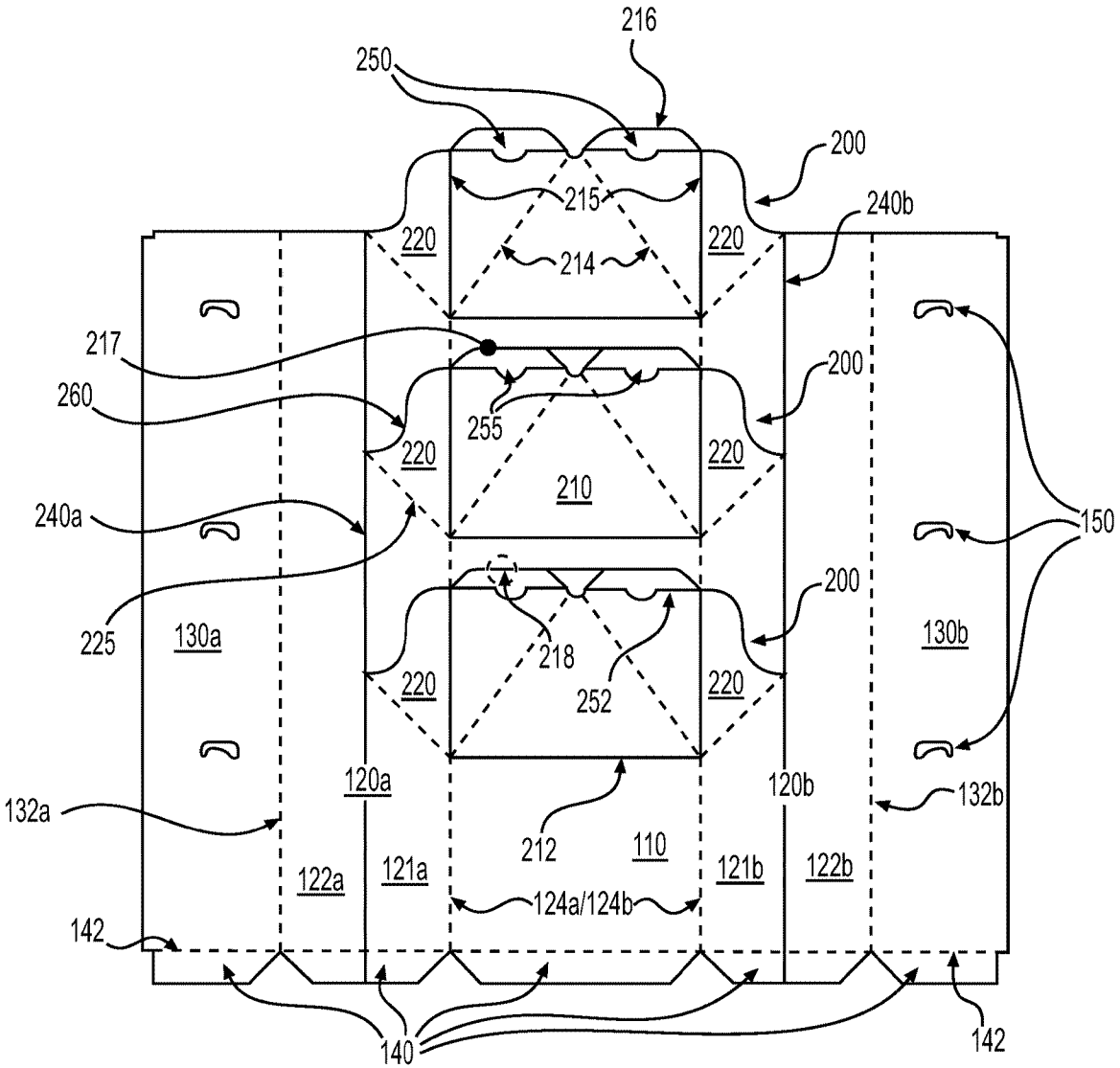
FIG. 1 is a plan view of a weekender style display according to embodiments of the present invention, the display shown in a knockdown configuration.
Figure 2:
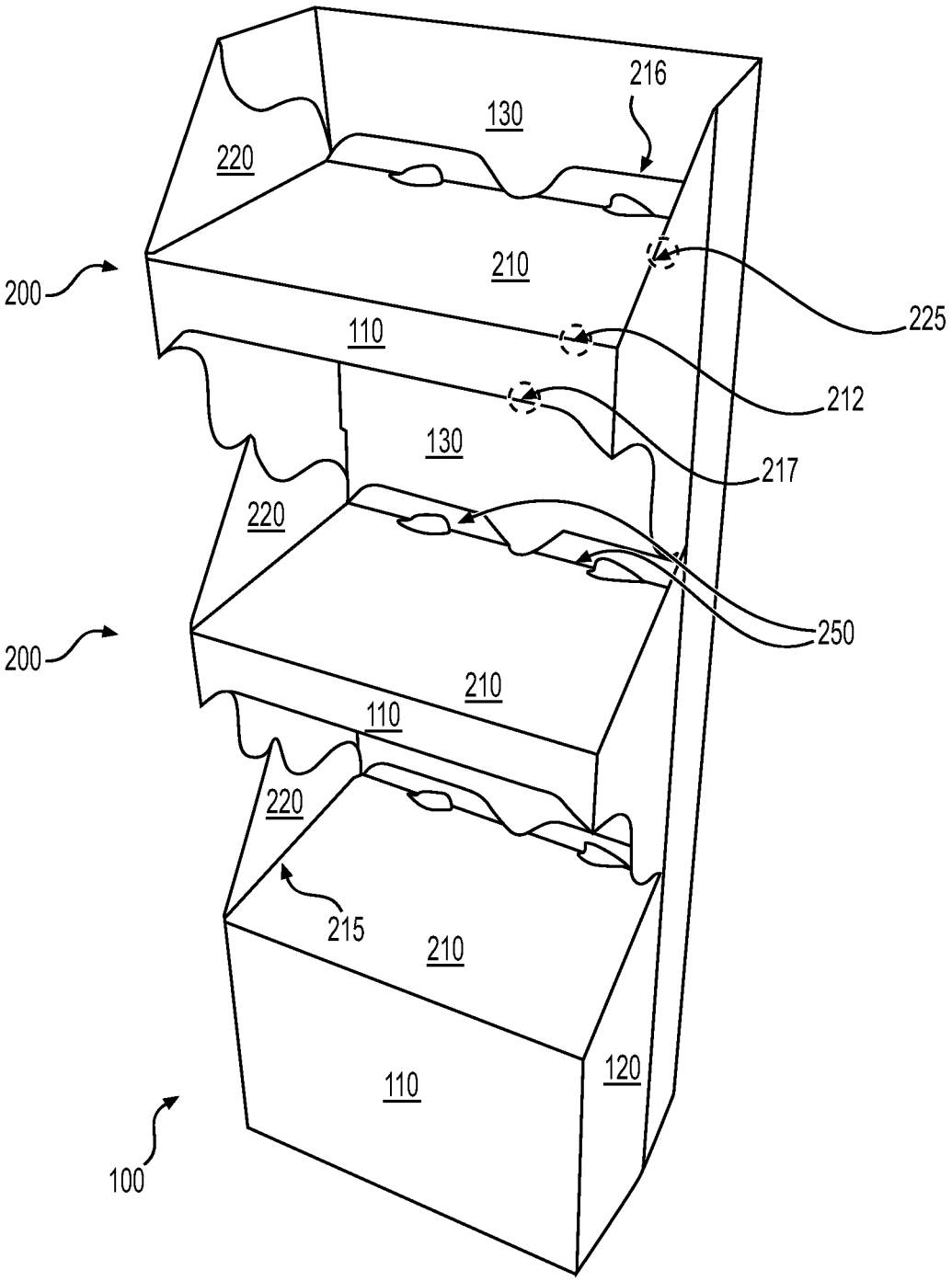
FIG. 2 is a perspective view of the weekender style display of FIG. 1, the display shown in an erected configuration.

Referring to FIG. 2, embodiments of the present invention include a weekender style display 10 having a base 100 and a plurality of shelf assemblies 200 for accommodating and displaying products such as, for instance, bagged snacks, pouches, or the like. In certain embodiments, the display 10 is formed from corrugated material, such as paperboard. However, other embodiments provide for the corrugated material to include other similar type materials, such as cardboard, fiberboard, or the like. The display is operable to be provided in a knockdown configuration (i.e., a generally flat, two-dimensional form), such as illustrated in FIGS. 1, 8, 9, 11, and 14. From the knockdown configuration, the display is operable to be transformed into an erected configuration, such as shown in FIGS. 2, 10, 12, and 13.

Referring to FIG. 1, an embodiment of the present invention is shown in a knockdown configuration that is substantially flat and convenient for shipping and/or storing. The embodiment shown includes a plurality of panels of the base 100, each panel being separated by one or more fold and/or cut line. From left to right, the panels of the base 100 include a first rear panel 130*a* separated by a fold line 132*a* from a first side panel 120*a*, a front panel 110 separated by a fold line 124*a* from the first side panel 120*a*, a second side panel 120*b* separated by a fold line 124*b* from the front panel 110, and a second rear panel 130*b* separated by a fold line 132*b* from the second side panel 120*b*. The first 130*a* and second 130*b* rear panels define a plurality of support apertures 150 sized and shaped to engage with respective shelve assemblies 200 of the display 10, such as by receiving respective tab members 255 of respective shelf assemblies 200. In some embodiments, each side panel 120*a*, 120*b* is segmented into respective front 121*a*, 121*b* and rear 122*a*, 122*b* portions, thereby facilitating folding of the same onto each other. In some embodiments, the display comprises a plurality of bottom panels 140, each bottom panel extending from a bottom edge of a respective rear panel, side panel, front panel, or the like.

In the embodiment shown, each side panel is hingedly coupled to each shelf assembly 200 at a line of weakness 225 (each a "support hinge" 225), such as, e.g., an 8-point roundtop rule foldable crease, each support hinge 225 extending from the fold line 124*a* and/or 124*b* separating the side panel from the front panel to a lateral mid-point 240*a/b* in the middle of the side panel. In this way, the support hinge 225 does not extend into the rear portion 122*a*, 122*b* of the respective side panel. In one embodiment, the support hinge 225 shown extends 45 degrees from horizontal when the display is erected. Each side panel 120*a*, 120*b* defines opposed cut lines 260 (such as the S-shaped cuts shown) associated with each shelf assembly, the cut lines extending from the fold line 124 separating the side from the front to mid-point 240 on the side panel where the support hinge 225 ends.

Figure 4:
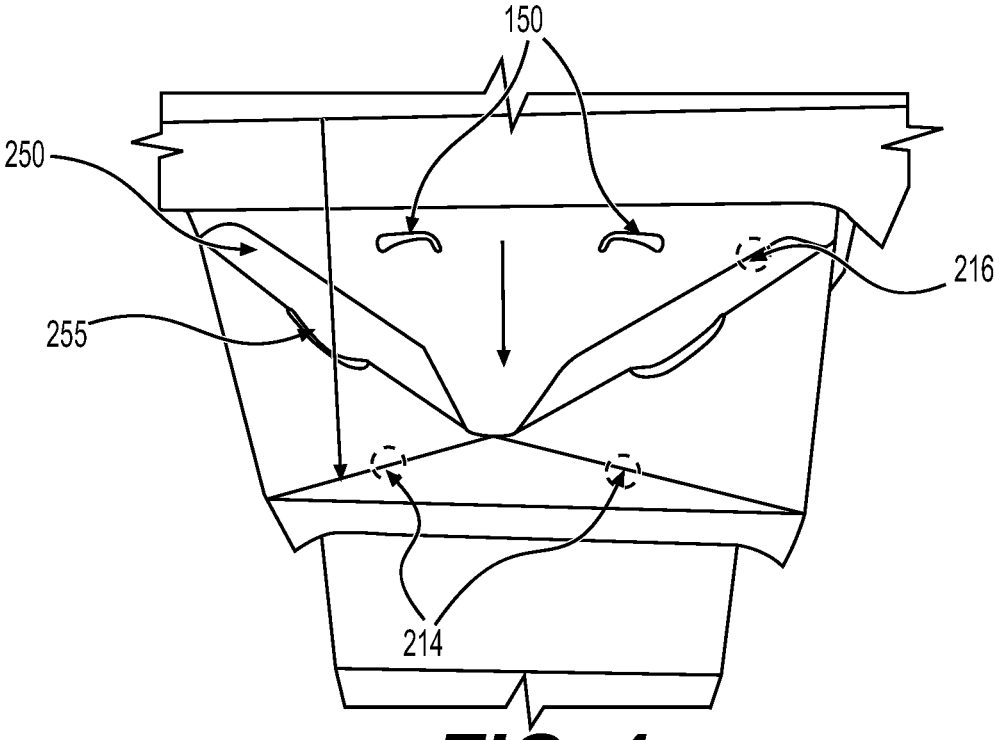
FIG. 4 is a partial perspective view showing a pulling step associated with moving a shelf member from a stowed configuration to a deployed configuration.

Still referring to FIG. 1, the plurality of panels defines a plurality of shelf assemblies 200, each shelf assembly 200 having a shelf member 210 extending between opposed front and rear edges. The front edge of each shelf member is hingedly coupled to the front panel (the "front hinge" 212), thereby facilitating movement of each shelf member 210 between a stowed position and a deployed position, each such position being associated with a respective stowed and deployed configuration of the shelf assembly. The stowed and deployed configurations of the shelf assemblies are associated with a flat configuration and the erected configuration of the display, respectively. In the stowed configuration, the rear edge 216 of each shelf member 210 and/or tab panel 250 is positioned adjacent to a peripheral edge 217 of the front panel 110 of the base 100, such as a peripheral edge formed by forming a cut line 218 between the front panel and the shelf member. In the deployed configuration, the rear edge 216 of the shelf member 210 is positioned adjacent to one or more rear panel 130*a*, 130*b* (together, the rear panel 130) of the display. In some embodiments, moving a shelf member from the stowed configuration to the deployed configuration comprises rotating the shelf member down and away from the front panel such that that the rear edge of the shelf member moves from a first position adjacent to the front panel to a second position adjacent to the rear panel 130, as depicted in FIG. 4.

Each shelf member defines opposed left and right side edges, each such side edge being hingedly coupled to a respective left and right side support panel 220. In some embodiments, each support panel 220 is defined by an area positioned between a cut line (such as the S-shaped cuts shown), a support hinge 225, and a longitudinal fold line (a "side hinge" 215) separating the shelf member 210 from the support panel 220. In some such embodiments, the side hinge 215 is colinear with a longitudinal fold line 124*a* and/or 124*b* that separates the front panel 110 from a respective side panel when the display is in the knockdown configuration.

The shelf member 210 is configured to deform as the shelf assembly 200 moves between its stowed and deployed configurations, thereby facilitating simultaneous bending at the support hinge 225 and the side hinge 215. In some embodiments, the shelf member 210 includes two relief hinges 214, such as fold lines or the like, to facilitate deformation of the shelf member 210. In some such embodiments, the relief hinge 214 is formed by a line of weakness extending diagonally from a front corner of the shelf member 210 towards a mid-region of the rear edge of the shelf member. Preferably, the relief hinge 214 line is located and oriented at an angle congruent to an angle of the support hinge 225.

In some embodiments, the shelf assembly 200 includes a tab panel 250 extending from a rear edge of the shelf member 210, each tab panel defining one or more tab member 255. The rear of the shelf member 210 is separated by a fold line 252 from the tab panel 250, thereby facilitating rotation of the same. Each rear tab panel 250 is configured to interface with a respective support aperture 150 when the display is in the erected configuration, wherein a tab member 255 inserts through its respective support aperture 150, thereby providing vertical support for a rear portion of the shelf member.

Referring to FIG. 2, the embodiment of FIG. 1 is shown in its erected configuration. A method of erecting the weekender display is discussed below and with reference to FIGS. 3-7. Erecting the display involves converting the display from its knockdown configuration, as shown in FIG. 1, to its erected configuration, as shown in FIG. 2. In some embodiments, the method further includes moving the display to a flat configuration, such as by securing first 130*a* and second 130*b* panels together so as to form a continuous panel assembly 130 and folding such panels against each other such that inner surfaces of a first group of panels are folded against inner surfaces of a second group of panels. In some embodiments, the method includes folding each side panel in half such that an inner surface of the front panel is folded against an inner surface of the rear panel. In some embodiments, the back panel 130 is a continuous panel and sub-panels 130*a* and 130*b* merely refer to each half of the back panel 130.

Figure 3:
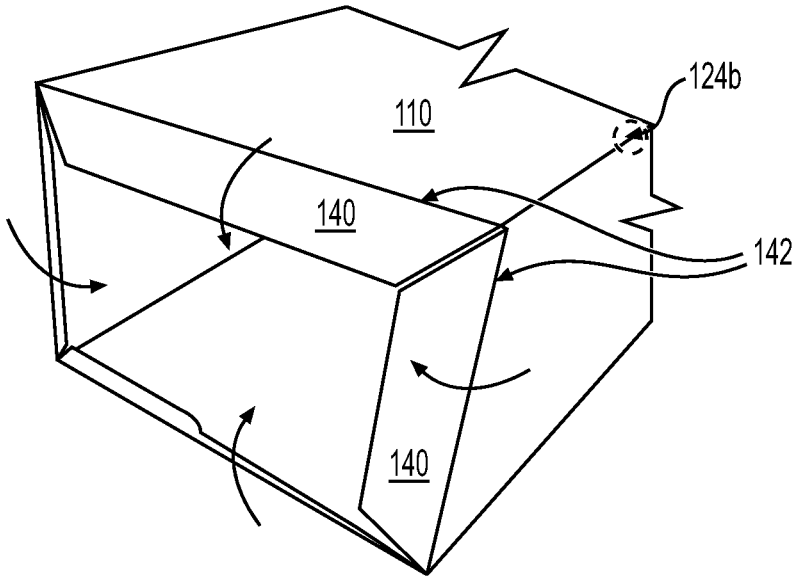
FIG. 3 is a partial perspective view of a bottom portion of a base of the weekender display of FIG. 1, the display shown mid-assembly and lying on one side and arrows showing rotation of flaps associated with such assembly.

Referring to FIG. 3, each rear panel is folded along the longitudinal fold line 132*a* and 132*b* approximately 90 degrees with respect to its adjacent side panel. Each side panel is folded along the longitudinal fold line 124*a* and 124*b* approximately 90 degrees with respect to the front panel. Thus, the display is folded along the longitudinal fold lines to form a box with an interior, with the front panel 110 at the front, the rear panels at the rear 130, and the two side panels 120*a* and 120*b* on each side of the interior of the box.

Still referring to FIG. 3, the bottom panels are folded inward along the bottom panel fold lines 142 toward the interior of the box, approximately 90 degrees to form a base 140 124*a* and/or of the display. FIG. 3 shows the display mid-assembly, being converted from the knockdown configuration to the erected configuration. For convenience, FIG. 3 shows the display lying on its rear panels, however, a person of ordinary skill in the art will appreciate that erecting the display does not require placing the display on its rear panels. The display could be placed on one side or its front panel. Or the bottom panels could be folded inward while keeping the display upright, without placing it on any side.

Figure 5:
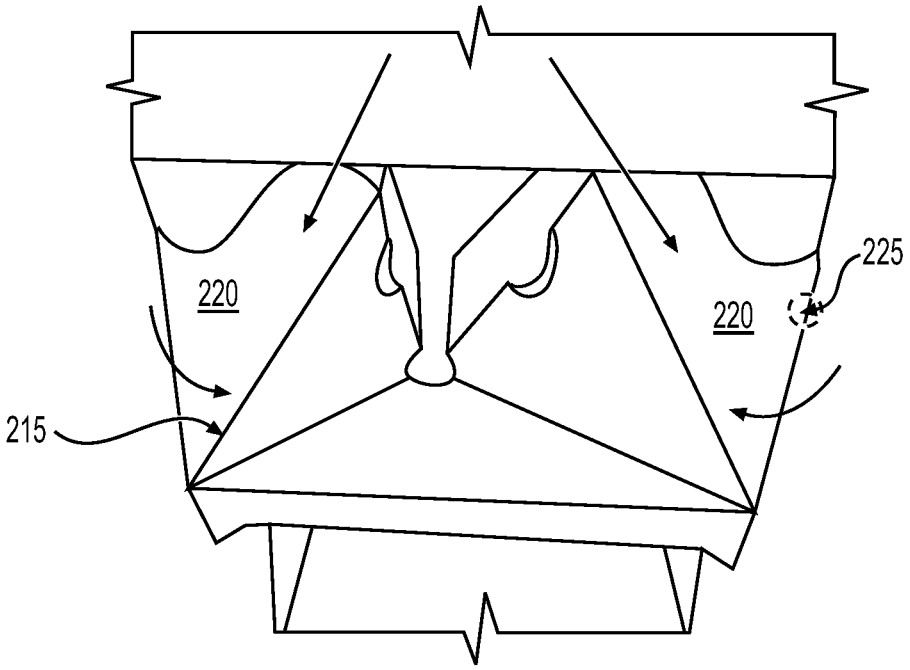
FIG. 5 is a partial perspective view showing an intermediate stage of moving a shelf assembly from a stowed configuration to a deployed configuration, the shelf assembly shown just after rotating support panels relative to side panels.

Referring to FIG. 4, the rear of the shelf is separated from the front panel at the cut line 218 and pulled outward, away from the interior of the box. Referring to FIG. 5, the shelf panel is pulled farther outward, away from the interior of the box. As can be seen in FIG. 5, as the shelf member 210 is pulled outward, the shelf side panel 220 separates from the side panel 120 at the S-shaped cut 260 and folds along the crease 225 and the longitudinal fold line 215. The shelf member 210 folds along each of the two fold lines 214. The shelf is pulled outward to the point where a portion of the shelf between the shelf fold line 214 and the longitudinal fold line 215 and the shelf side panel 220 are parallel.

Figure 6:
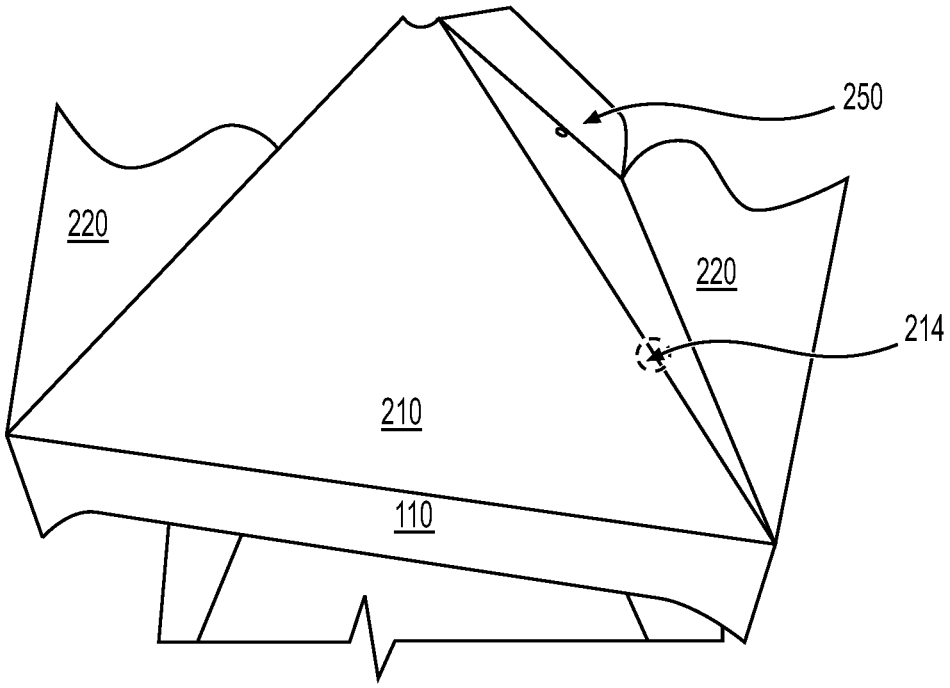
FIG. 6 is a partial perspective view showing an intermediate stage of moving a shelf assembly from a stowed configuration to a deployed configuration, the shelf assembly shown just before rotating a rear edge of shelf member against a rear wall of a base.

Referring to FIG. 6, the shelf side panel 220 and shelf portion 210 are popped inward and pushed inward as the shelf is pushed inward toward the rear panel 130. The shelf 210 is pushed farther inward until it is substantially horizontal and perpendicular to the rear 130, side 120, and front panels 110.

Figure 7:
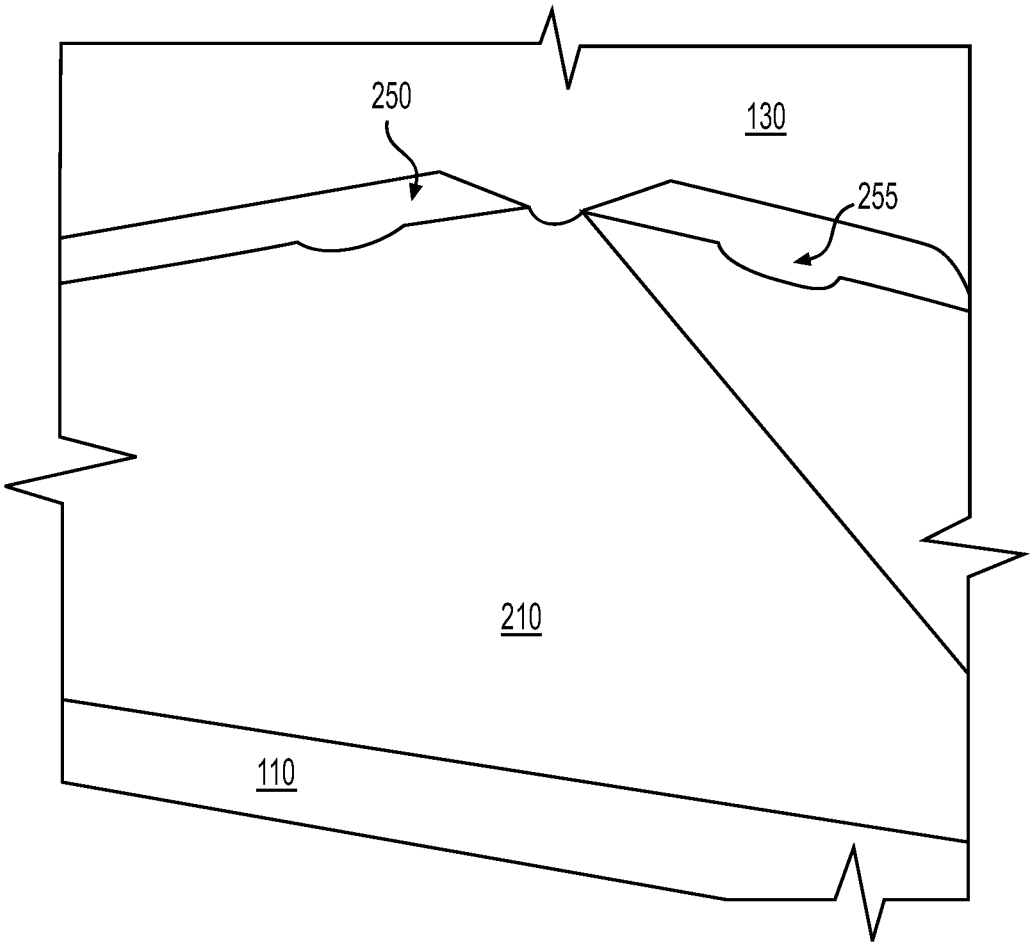
FIG. 7 is a partial perspective view showing an intermediate stage of moving a shelf assembly from a stowed configuration to a deployed configuration, the shelf assembly shown just before engaging support tabs with respective support apertures.

Referring to FIG. 7, the shelf tab panel 250 is folded along the tab panel fold 252 and engaged with the respective hole 150 on the rear panel 130. The tabs at the rear of the shelf provide support at the rear. The fold 212 at the front of the shelf provides support at the front. The fold 225 along the crease provides support at the sides of the shelf. The process is repeated for each shelf until the display is in its erected configuration.

Figure 8:
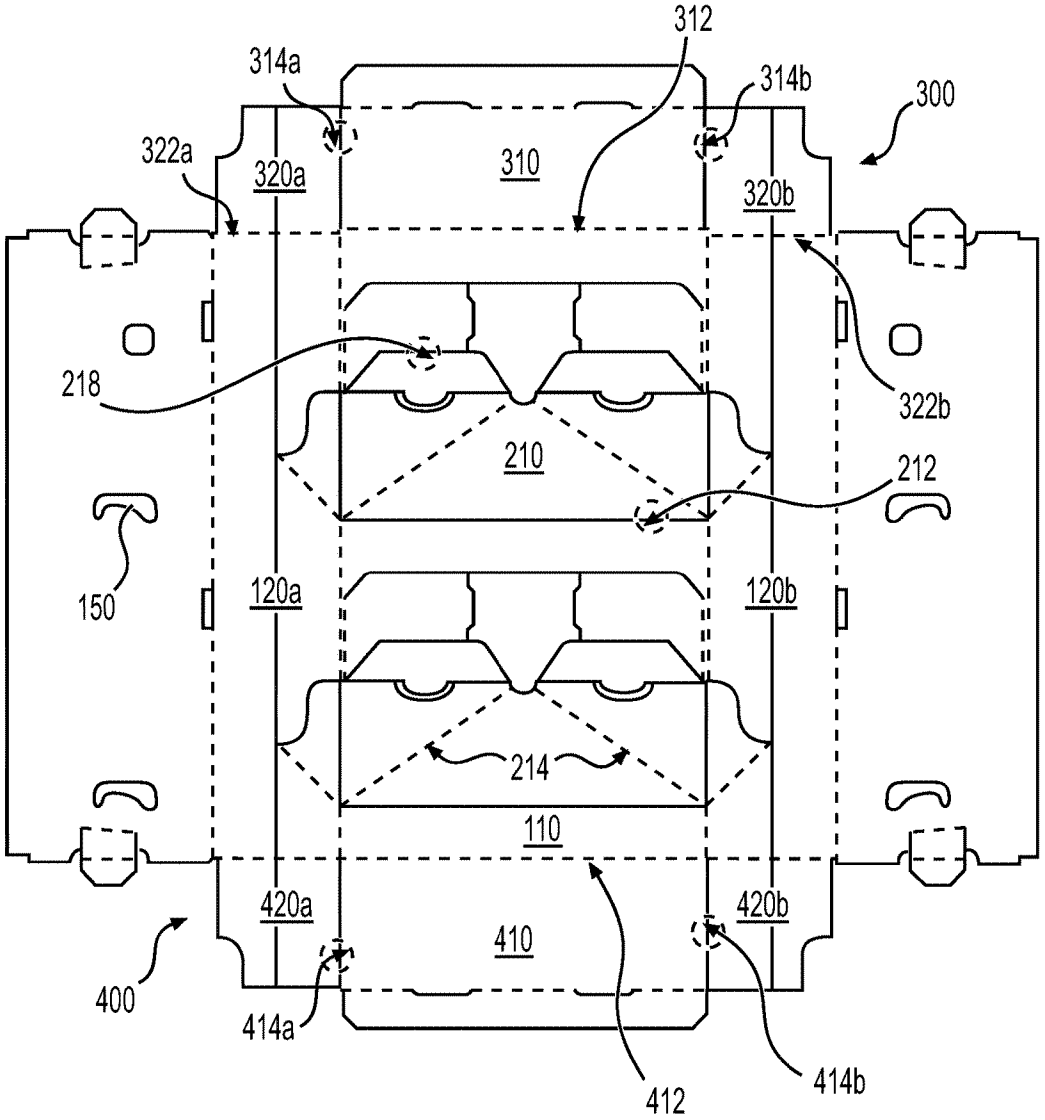
FIG. 8 is a plan view of a weekender style display according to other embodiments of the present invention.

The embodiment shown in FIG. 8 is shown in its knockdown configuration. The embodiment shown in FIG. 8 includes a top panel 310 separated by a lateral fold line 312 from the front panel 110 and a bottom panel 410 separated by a lateral fold line 412 from the front panel 110. The display also includes top side panels 320*a* and 320*b* separated by a fold line 322*a* and 322*b* from the respective side panels 120*a* and 120*b* and separated by a cut line 314*a* and 314*b* from the top panel 310. The display also includes bottom side panels 420*a* and 420*b* separated by a fold line 422*a* and 422*b* from the respective side panels 120*a* and 120*b* and separated by a cut line 411*a* and 414*b* from the bottom panel. The erected configuration is substantially similar to the erected configuration previously discussed, but with the top 310, top side 320, bottom 410, and bottom side panels 420 providing additional structural support to the erected display.

The process of converting the display from the knockdown configuration to the erected configuration is substantially similar to the process discussed with respect to other embodiments, but also includes folding the top panel 310 and top side panels 320*a* and 320*b* along the lateral fold lines 312 and 322*a* and 322*b*, respectively, and affixing the panels to each other, via tabs and holes, adhesive, or other similar means.

Figure 9:
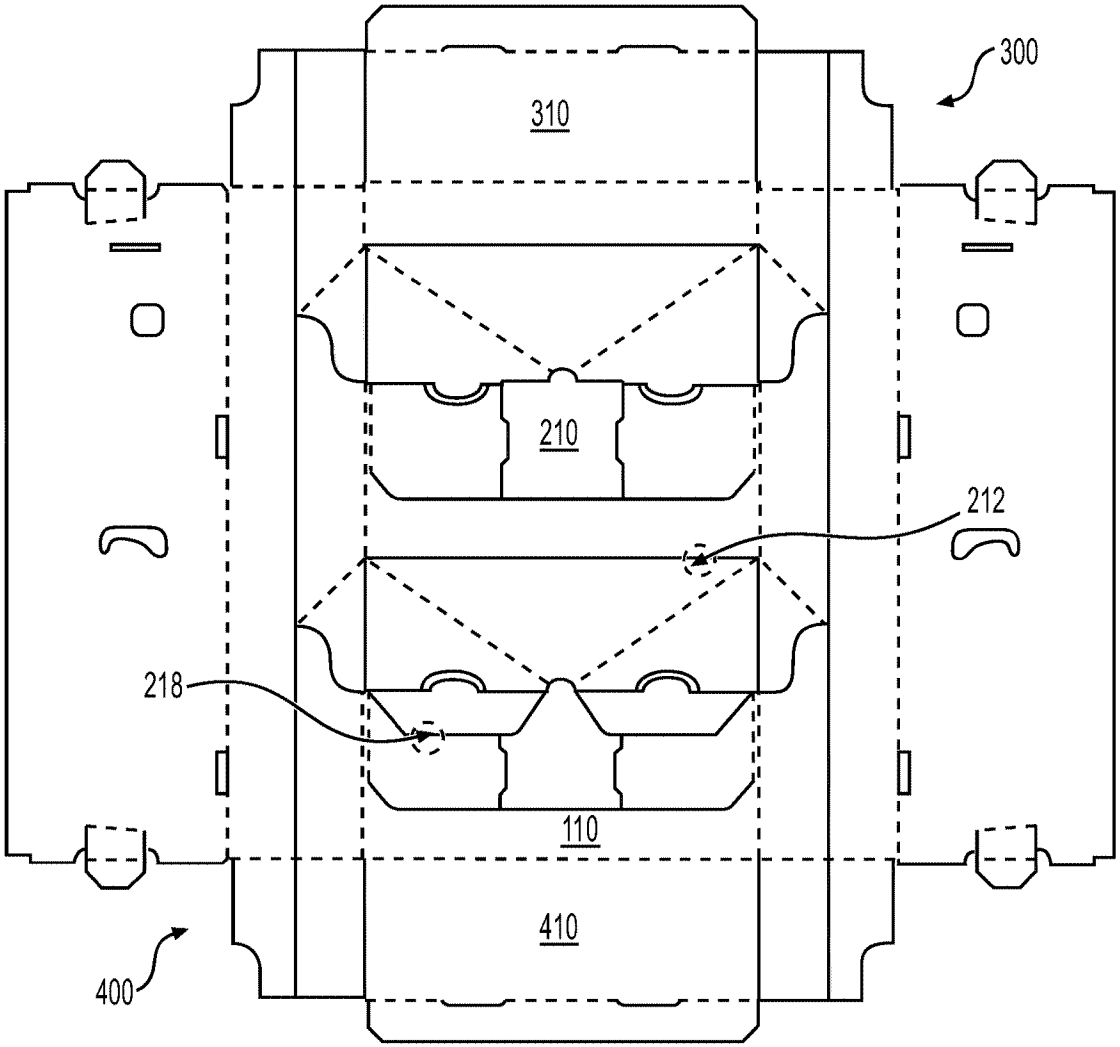
FIG. 9 is a plan view of a weekender style display according to still other embodiments of the present invention.

The embodiment shown in FIG. 9 is shown in its knockdown configuration. The embodiment shown in FIG. 9 is substantially similar to the embodiment shown in FIG. 8, but the shelf members 210 shown in FIG. 9 have the lateral fold 212 at the top and the cut 218 at the bottom, while the embodiment shown in FIGS. 8 and 1 show the shelf members with the fold 212 at the bottom and the cut 218 at the top.

Figure 10:
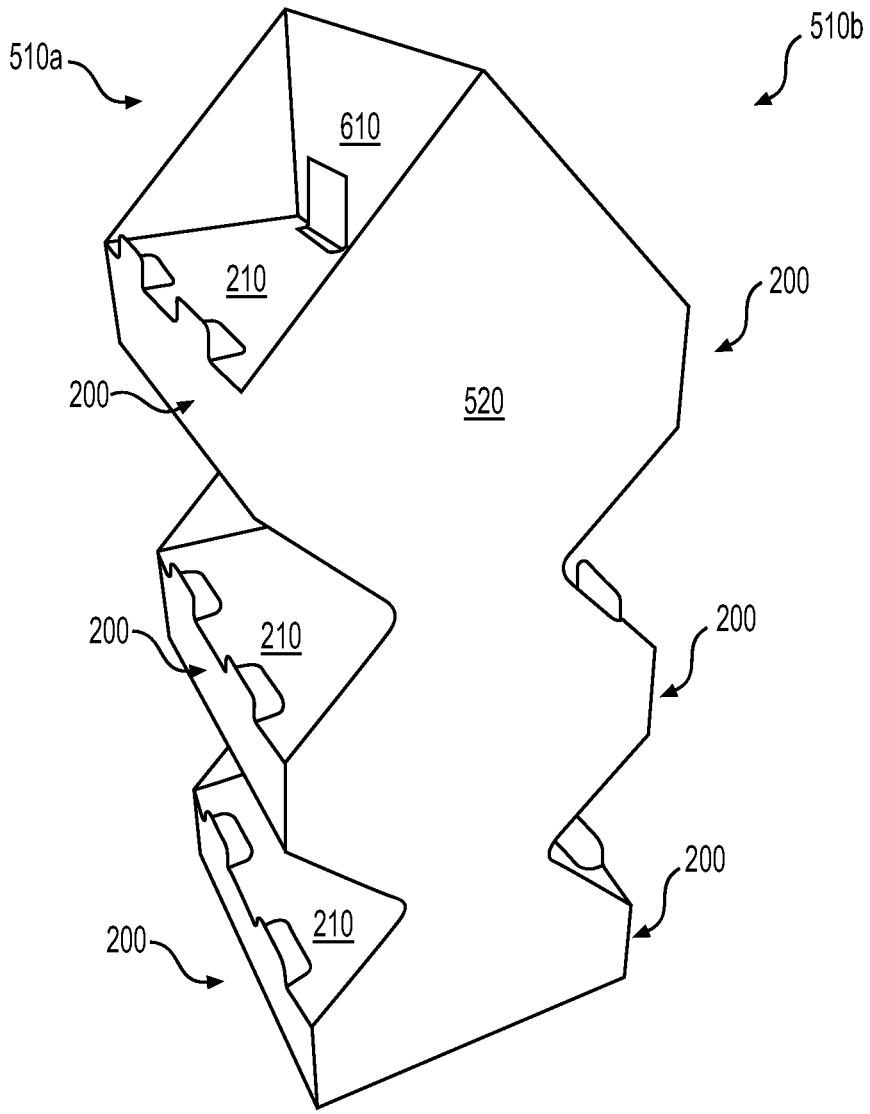
FIG. 10 is a perspective view of a weekender style display according to yet other embodiments of the present invention, the display shown in an erected configuration.

Referring to FIG. 10, some embodiments include a display 10 with opposing shelf members 210 when in an assembled configuration. In some embodiments, the display 10 is assembled from a continuous piece of material, typically (but not always) corrugated cardboard. In some embodiments, the display 10 in the assembled configuration possesses one or more opposing shelf assemblies 200. In some embodiments, said shelf assemblies 200 are formed from folded cardboard. In some embodiments, angled folds are utilized to create opposed first shelving scene 510*a* and second shelving scene 510*b*, said scenes each being defined by one or more shelf members 210 which oppose the orientation of one or more corresponding shelves associated with the other scene. In some embodiments, the scenes are separated by at least one connected sidewall 520 and a shared backwall 610, and in other embodiments there are two connected sidewalls 520 and a shared backwall 610. In some embodiments, the entire display consists of a single, continuous piece of material which is folded to create opposing shelving scenes 510*a* and 510*b*, each scene with one or more shelf member 210.

Figure 11:
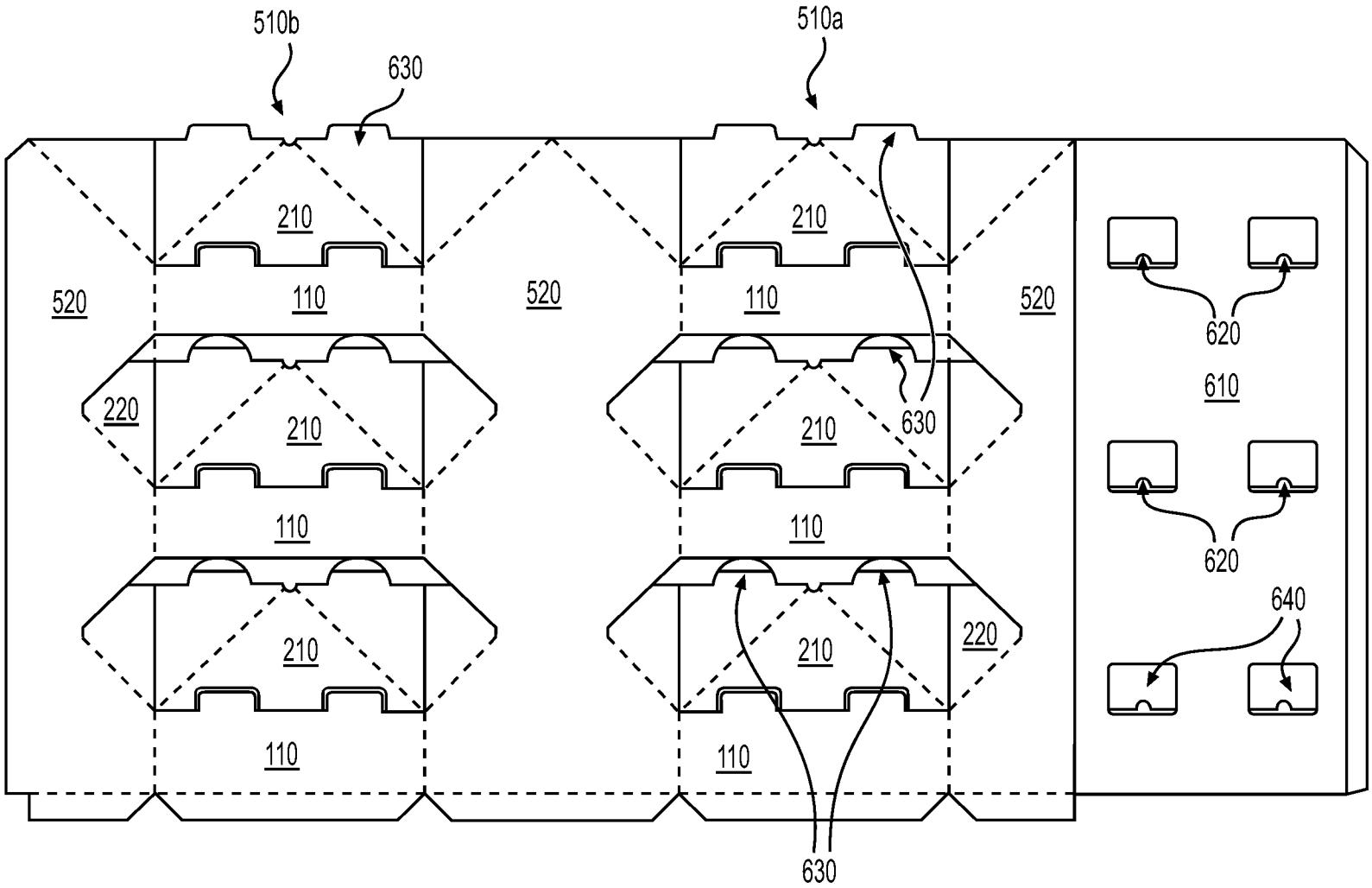
FIG. 11 is a plan view of the weekender style display of FIG. 10 shown in a knockdown configuration.

Referring to FIG. 11, some embodiments include a display, as depicted in FIG. 10, in a knockdown configuration. In such embodiments, said knockdown configuration includes a continuous piece of material. In some embodiments, said continuous piece of material includes one or more fold lines and/or one or more cut lines. In some embodiments, such fold lines and/or cut lines define one or more shelving members 210.

Still referring to FIG. 11, some embodiments include fold lines which define one or more panels. In some embodiments, said panels are associated with one or more sidewalls 520 of a display. In some embodiments, said panels are associated with one or more shelving scene 510*a* and/or 510*b*, where in some embodiments each scene is defined by one or more panels which are associated with one or more shelf members 210. In some embodiments, at least one of said panels is associated with an intermediary element, which when in an assembled configuration serves as a back wall 610 for at least one shelf member. In other embodiments, said intermediary element serves as a back wall 610 for at least two opposing shelf members. In this way, such an intermediary element serves as a single element with opposing faces, each face serving as the back wall 610 to at least one corresponding shelf member.

In some embodiments, a shelf assembly 200 includes fold lines and/or cut lines and/or cut outs which correspond to locking tabs 630. In such embodiment, said locking tabs 630 are configured to engage with a corresponding receiving element 620, such as an aperture defined by an intermediate panel, a rear panel, or the like (each a "vertical panel") (e.g., back wall 610). In some embodiments, the receiving element 620 includes a support flap 640, such as a support flap formed from the vertical panel, the support flap 640 being hingedly coupled to the vertical panel 610 such that the receiving element 620 is moveable between an open configuration and a closed configuration. In the closed configuration, the receiving element 620 defines a support slot that is configured to receive a tab member 630 from each of two opposed shelf assemblies 200 (front and rear shelf member), such as by allowing the tab members 630 to extend past each other. In the open configuration, the receiving element 620 defines a large aperture that is configured to allow the tab members to move in and out of the support slot, the large aperture being formed by folding the support flap 640 away from the vertical panel 610, thereby defining a void in the vertical panel. In some embodiments, the support flap 640 is configured to restrain the tab members 630 in the support slot when the receiving element 620 is in the closed configuration, thereby moving the display to a locked configuration.

Figure 12:
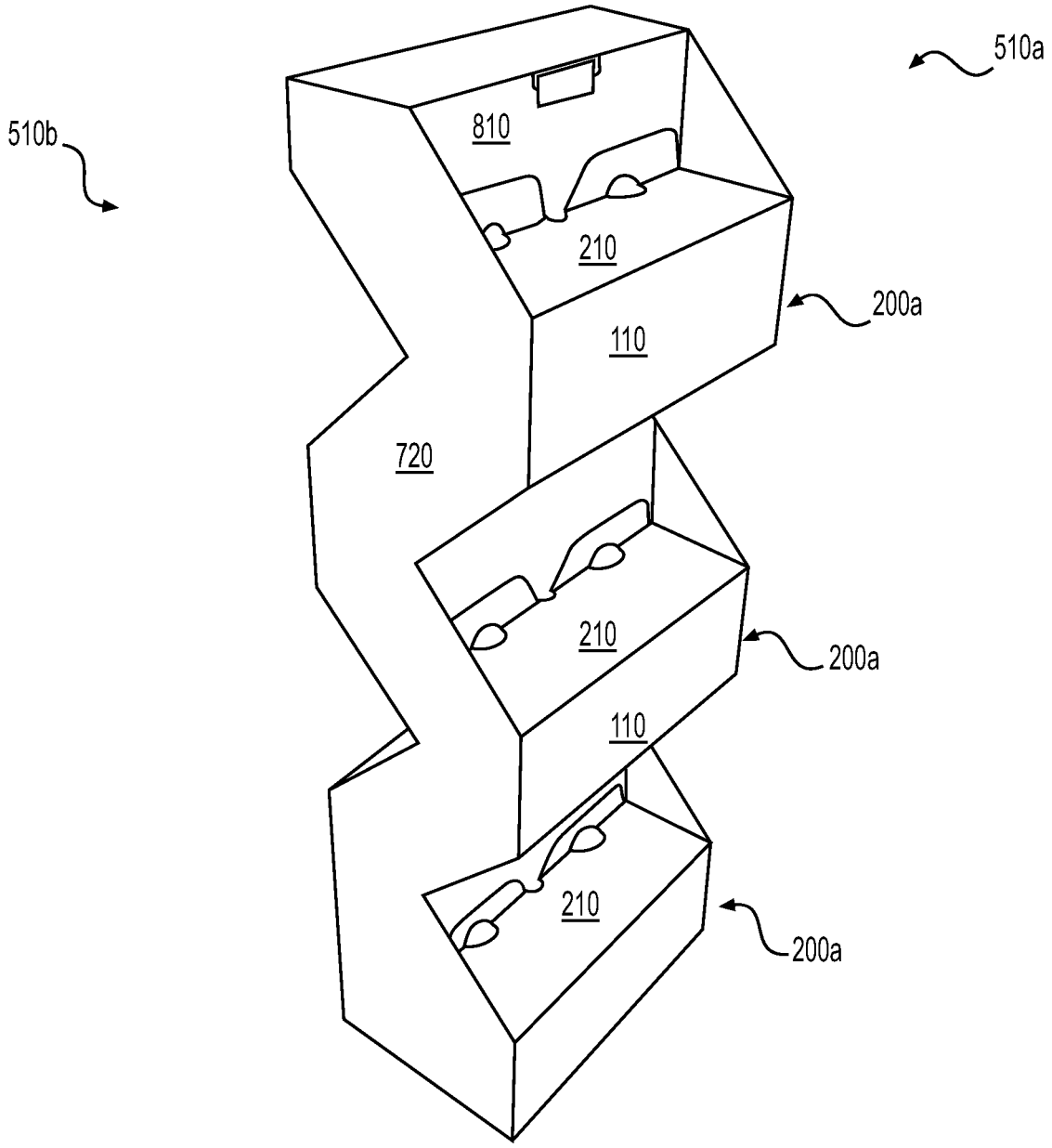
FIG. 12 is a perspective view of a weekender style display according to other embodiments of the present invention, the display shown in an erected configuration.
Figure 13:
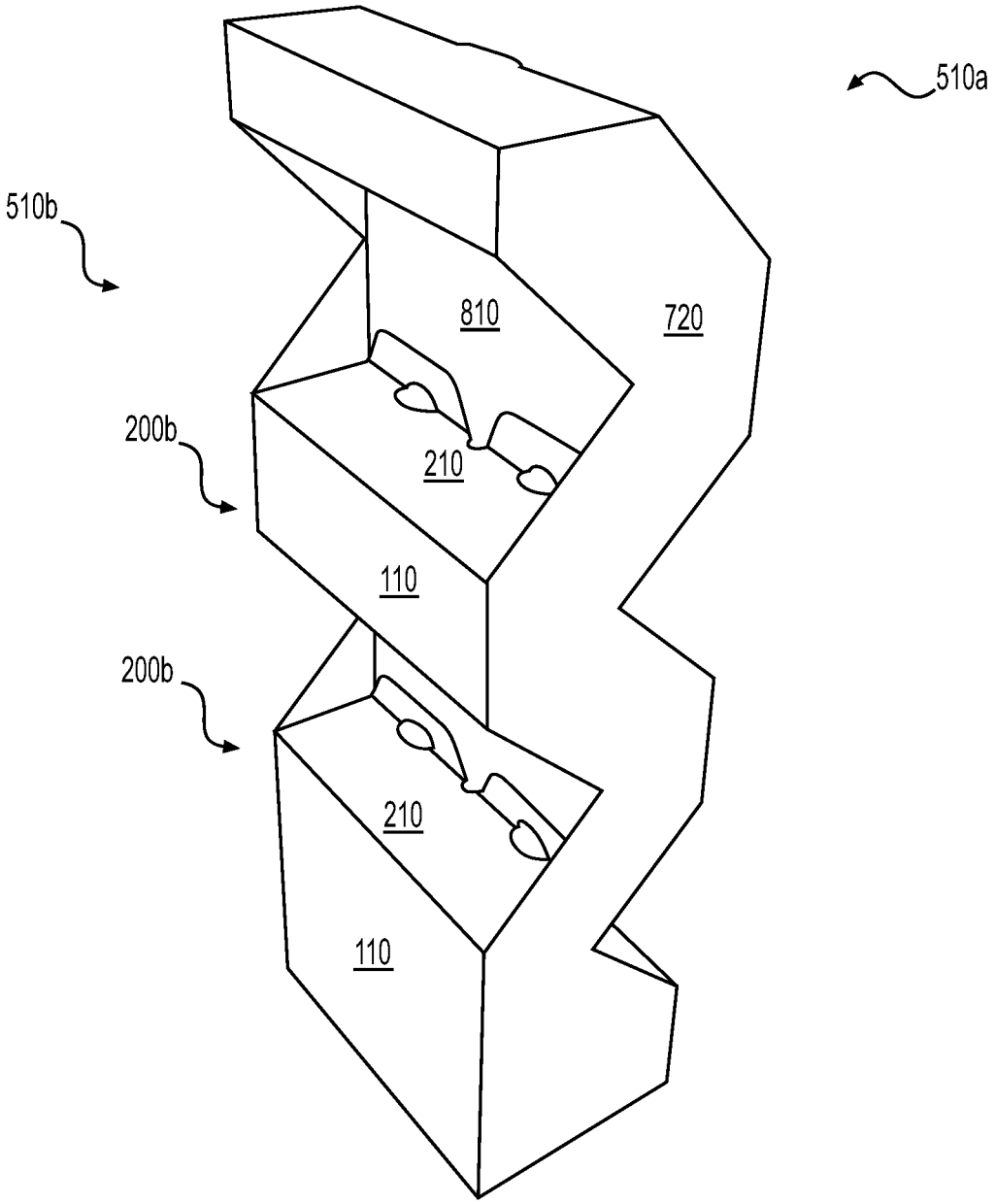
FIG. 13 is a perspective view of the weekender style display of FIG. 12, shown from a different angle.

Referring to FIGS. 12 and 13, some embodiments of the present invention include a display with alternating opposing shelf members 210 when in an assembled configuration. In some embodiments, the display is assembled from a continuous piece of material, typically (but not always) corrugated cardboard. In some embodiments, the display in the assembled configuration possesses one or more alternating opposing shelf members 210. In some embodiments, said shelf members are formed from folded cardboard. In some embodiments, angled folds are utilized to create opposed first shelving scene 510*a* and second shelving scene 510*b*, said scenes each being defined by one or more shelf members 210 which oppose the orientation of one or more corresponding shelf members 210 associated with the other scene. In some embodiments, the scenes are separated by at least one connected sidewall 720 and a backwall 810, and in other embodiments there are at least two connected sidewalls 720 and a backwall 810. In some embodiments, the entire display consists of a single, continuous piece of material that is folded to create opposing shelving scenes, each scene with one or more shelf member.

Figure 14:
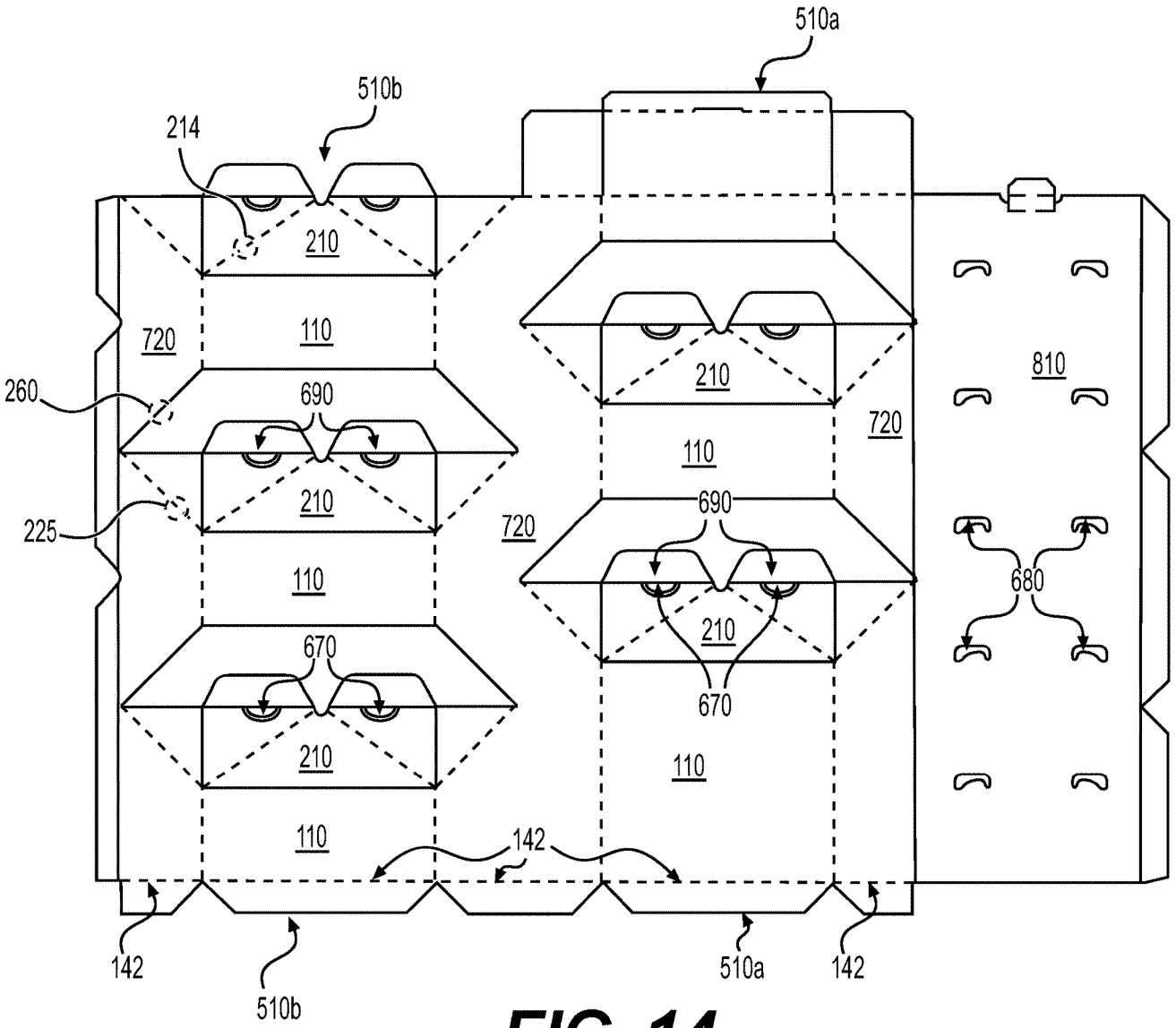
FIG. 14 is a plan view of the weekender style display of FIG. 12, shown in a knockdown configuration.

Referring to FIG. 14, a knockdown configuration of another embodiment is shown. In such embodiment, the knockdown configuration includes a continuous piece of material. In some embodiments, the continuous piece of material includes one or more fold lines and/or one or more cut lines. In some embodiments, such fold lines and/or cut lines define one or more shelving members 210. In some embodiments, said shelving members 210 are configured such that when in an assembled configuration, said shelving members are in an opposing, alternating configuration, such as depicted, e.g., in FIGS. 12 and 13.

Still referring to FIG. 14, some embodiments include fold lines which define one or more panels. In some embodiments, said panels are associated with one or more sidewalls 720 of a display. In some embodiments, said panels are associated with one or more shelving scene 510*a* and or 510*b*, where in some embodiments each scene is defined by one or more panels which are associated with one or more shelves. In some embodiments, at least one of said panels is associated with an intermediary element, which when in an assembled configuration serves as a back wall 810 for at least one shelf member 210. In other embodiments, said intermediary element serves as a back wall 810 for at least two opposing, alternating shelf members 210. In this way, such an intermediary element serves as a single element with opposing faces, each face serving as the back wall 810 to at least one corresponding alternating shelf member 210.

In some embodiments, a shelf assembly 200 includes fold lines and/or cut lines and/or cut outs which correspond to locking tabs 670. In such embodiment, said locking tabs 670 are configured to engage with a corresponding receiving element 680. In some embodiments, said receiving element 680 is associated with one or more fold lines and/or cut lines and/or cut outs, which in some embodiments are located on an intermediary element 810. In some embodiments, said receiving elements 680 receive only a single tab 670, while in other embodiments said receiving elements 680 are configured to receive more than one tab 670. In some such embodiments, said receiving elements 680 are configured to receive more than one tab 670 from any given direction, and/or said receiving elements 680 are configured to receive more than one tab 670 from opposing directions. Thus, said intermediary element 810 with its receiving elements 680 is capable of supporting one or more opposing shelf members 210 by receiving one or more locking tabs 670 and subsequently supporting said one or more shelf members 210.

Referring to FIG. 10, some embodiments of the display in an assembled configuration have shelving members which are directly opposed from one another across an intermediate element. In such embodiments, said opposing shelving members 210 are positioned equidistant from the bottom of the shelving unit. In other embodiments, such as FIG. 13, the display in an assembled configuration has shelving members 210 are opposed from one another but are not directly opposed. In such embodiments, said opposing shelving members are positioned at different distances from the bottom of the shelving unit. In yet further embodiments, the display in an assembled configuration includes both shelving members which are directly opposed from one another and which are opposed from one another but not directly opposed. In some embodiments, the display in an assembled configuration includes pairs of shelving members that are directly opposed from one another and individual, unpaired shelving members that are opposed from one another but not directly opposed.

The present invention further includes a process for moving a multi-sided display from a knockdown configuration to an erected configuration. For the embodiments having an intermediary element 610 or 810 or the like, the process includes additional and/or different considerations beyond those discussed above for single-sided displays. In some embodiments, the process includes securing the intermediate element between two or more shelving scenes 510*a* and/or 510*b*. In some embodiments, the shelving scenes comprise one or more shelf members 210, each shelving member having one or more locking tabs 630 or 670. In some embodiments, the intermediary element 610 or 810 is situated between the two shelving scenes 510*a* and 510*b* such that said locking tabs 630 or 670 align with one or more receiving elements 620 or 680 of the respective intermediary element 610 or 810. In some embodiments, the process includes mating or joining the one or more receiving elements 620 or 680 to the one or more locking tabs 630 or 670 such that the intermediary element serves as a back wall 610 or 810 for one or more shelf members 210 of the display. In some embodiments, the assembled configuration results in pairwise opposing shelf members 210, while in other configurations the assembled configuration results in opposing, alternating height shelf members 210.

In some embodiments, the process includes moving a receiving element 620 to an open configuration so as to allow one or more tab member 630 to move into engagement with a respective tab slot. In some embodiments, the process includes moving the receiving element 620 to a closed configuration, thereby preventing or otherwise habiting the tab member 630 from moving out of the respective tab slot.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

What is claimed is:

1. A display comprising:

(a) an intermediary panel comprising at least four support apertures;

(b) two side panels;

(c) a front panel;

(d) a rear panel;

(e) at least two front shelf assemblies, each front shelf assembly comprising a portion of the front panel, a shelf member panel, and a tab panel with a tab member, wherein each front shelf assembly is pivotably connected to a section of the front panel by a fold line respectively; and (f) at least two rear shelf assemblies, each rear shelf assembly comprising a portion of the rear panel, a shelf member panel, and a tab panel with a tab member, wherein each rear shelf assembly is pivotably connected to a section of the rear panel by a fold line respectively;

wherein the at least two front shelf assemblies and the at least two rear shelf assemblies form opposing shelf members that are vertically offset from each other in an alternating manner, and wherein the at least four support apertures are configured to receive the tab members of the at least two front shelf assemblies and the at least two rear shelf assemblies respectively, the intermediary panel is separated from at least one of said two side panels by a fold line, the intermediary panel is between the front panel and the rear panel when the display is in an assembled configuration, and each tab panel of the at least two front shelf assemblies is separated from the front panel by a cut line respectively.

2. The display of claim 1, wherein (i) the shelf member panel is separated from the portion of the front panel by a front fold line, (ii) the shelf member panel is separated from the tab panel by a rear fold line, (iii) the front fold line is proximate to a front of the display, (iv) the rear fold line is proximate to a rear of the display, and (iv) the front fold line is parallel to the rear fold line.

3. The display of claim 1 further comprising:

(i) a first bottom panel that is separated from said front panel by a fold line, (ii) a second bottom panel that is separated from a first of said two side panels by way of a fold line;

(iii) a third bottom panel that is separated from a second of said two side panels by way of a fold line, and (iv) a fourth bottom panel that is separated from the rear panel by a fold line.

4. The display of claim 1 comprising opposed first and second shelving scenes, wherein (i) said first shelving scene comprises said at least two front shelf assemblies and said second shelving scene comprises said at least two rear shelf assemblies, (ii) each shelving scene shares the intermediary panel, (iii) the scenes are separated by the two side panels, and (iv) said first shelving scene comprises said front panel and said second shelving scene comprises said rear panel.

5. The display of claim 1, wherein the display consists of a single piece of material.

6. The display of claim 5, wherein the material comprises corrugated cardboard.

* * * * *